United States Patent [19]

Kochey, Jr.

[11] 4,387,668

[45] Jun. 14, 1983

[54] TUBE ARRANGEMENT FOR FURNACE WALL

[75] Inventor: Edward L. Kochey, Jr., Colebrook, Conn.

[73] Assignee: Combustion Engineering, Inc., Windsor, Conn.

[21] Appl. No.: 335,005

[22] Filed: Dec. 28, 1981

[51] Int. Cl.[3] ..... F22B 37/00

[52] U.S. Cl. ..... 122/6 A; 122/235 A; 122/235 K

[58] Field of Search ..... 122/6 A, 235 A, 235 C, 122/235 D, 235 J, 235 K, 275, 456, 511, 253, 122/255, 278, 311, 336, 406 S, 451 S; 137/335, 563

[56] References Cited

U.S. PATENT DOCUMENTS

| | | | |
|---|---|---|---|
| 1,268,549 | 6/1918 | De Strens | 122/235 K |
| 2,423,997 | 7/1947 | Ruegg | 122/275 |
| 3,033,535 | 5/1962 | Schaap | 122/235 A |
| 3,804,070 | 4/1974 | Michel . | |
| 4,160,701 | 7/1979 | Dorner | 122/235 K |
| 4,178,881 | 12/1979 | Pratt et al. . | |

*Primary Examiner*—Henry C. Yuen
*Assistant Examiner*—David E. Helmbold
*Attorney, Agent, or Firm*—Edward L. Kochey, Jr.

[57] ABSTRACT

A spiral wound furnace has the spiral wound tubes (18) terminated at the upper end by a vertically sinuous tube (25) with an upper return bend (36) and a lower return bend (38). The lower return bend (38) has a restricted area connection (42) connected to spiral wound tube (18), while the upper return bend (36) has a restricted area connector (44) fluidly connected to header (16).

3 Claims, 4 Drawing Figures

TUBE ARRANGEMENT FOR FURNACE WALL

BACKGROUND OF THE INVENTION

This invention relates to once-through steam generators and, in particular, to a furnace wall tubing arrangement located at the upper end of a spirally wound furnace.

In once-through steam generators the mass flow through the furnace wall tubes varies in proportion to the load on the boiler. At the minimum through flow condition there must be sufficient velocity in the tubes to prevent their overheating, because of poor heat transfer between the water and the tube. Since insufficient velocity may be obtained with vertical tubes lining the walls, one method used for increasing the velocity is to form a spiral wound furnace where the tubes wind around the furnace walls in the form of a helix. The number of tubes required to cover the furnace wall is substantially reduced and accordingly increased velocity occurs in each tube.

At the upper end of the furnace, provision must be made for the outlet of the flue gases. Continuing the helix in this area would create substantial complications in tubing layout and accordingly vertical tubes are resorted to in this area. Since the heat absorption rate is less than that down in the furnace area, a lower mass flow in each tube can be tolerated, and accordingly one method of cooling the upper walls involves trifurcating each of the spiral wound tubes into three tubes which pass vertically upward, thereby covering the upper furnace walls.

When operating at subcritical conditions each of these triforcates tends to operate as a steam water separator with the plurality of the water continuing to the farther most tube while the closer tubes tend to carry more steam. At high loads the maldistribution is no problem since all three tubes still remain at the same temperature and sufficient pressure drop is available to pass the flow upwardly through all the tubes.

At low loads, however, this water separating phenomena causes the farther most tube to fill partially with water. All the additional flow is thereafter passing up the two closer tubes until a sufficient load is reached such that the pressure drop through these tubes will push the water leg through the farther most tube. Once the solid water leg has been broken through, the flow resumes in all three circuits.

While this is occurring, the upper portion of the blocked tube receives no cooling and accordingly is susceptable to overheating. There is potential damage due to overheating itself and also potential damage caused by water quenching the hot tube once the flow starts.

It appears that it would be possible to continue the single tube upwardly into a vertically sinuous loop making three passes on the wall instead of trifurcating to the three separate curcuits. This, however, creates problems in potential steam or air trapping in the upper return bend and water pocketing in the lower return bend. The air pocket could be a problem during acid washing of the unit where insufficient flow is achieved to create a pressure differential sufficient to clear that particular tube. Accordingly, that entire circuit would be blocked and not washed.

The lower return bend being blocked by water creates an undrainable circuit which precludes completely draining the unit after an acid wash.

DESCRIPTION OF THE PREFERRED EMBODIMENT

Figure 1:
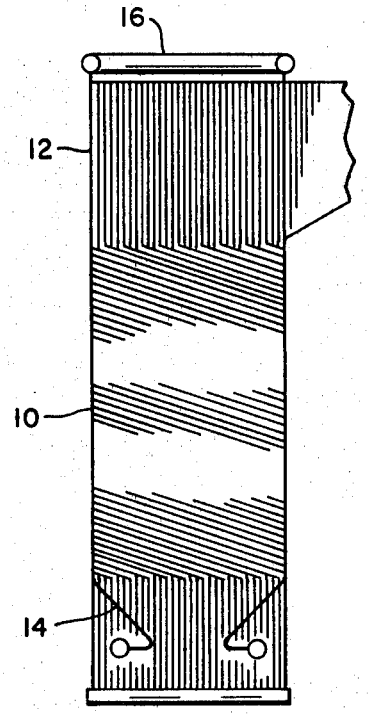
FIG. 1 illustrates a general furnace tubing arrangement of a spiral wound furnace.

FIG. 1 illustrates a spiral wound furnace 10 with the winding occuring at about 18 degrees from the horizontal. Accordingly, using the same center line to center line tube spacing, the number of vertical tubes in the upper furnace 12 and lower furnace 14 are three times the number in the spiral wound furnace. The flow passing through the water walls discharges into outlet header 16.

Figure 2:
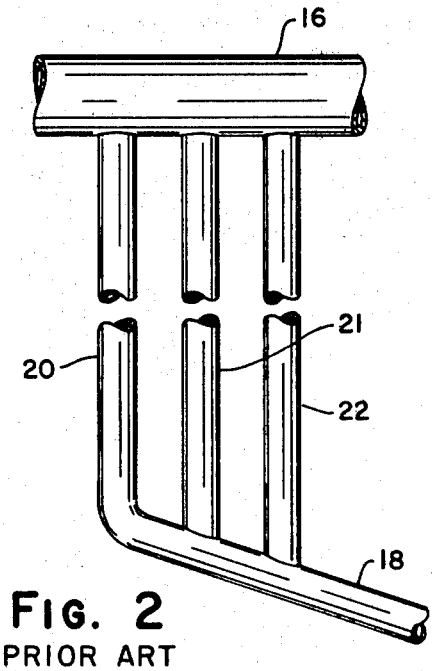
FIG. 2 PRIOR ART
FIG. 2 illustrates the prior art trifurcate arrangement.

FIG. 2 illustrates a prior art transition wherein one of the spiral tubes 18 is trifurcated into three vertical tubes 20, 21 and 22 respectively. These tubes have substantially the same spacing as the spiral wound tubes and continue up to outlet header 16.

During low load operation with the water steam mixture passing through tube 18, water collects in tube 20 of a height such that the static head in that tube is equal to the static head of the steam water mixture in tubes 21 and 22 plus the friction drop through tubes 21 and 22. The upper portion of tube 20 is uncooled. Only when the pressure drop through tubes 21 and 22 is sufficient because of an increased load can the water leg in tube 20 be pushed into the header and cleared to arrive at a relatively uniform float condition amongst three tubes. The trifurcate itself has a relatively difficult component to fabricate compared to the return bends of my invention.

Figure 3:
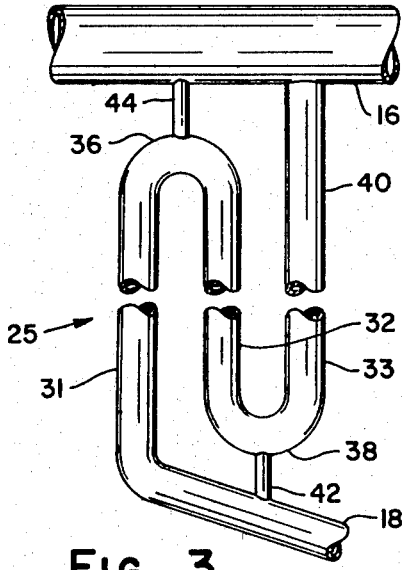
FIG. 3 illustrates the drained sinuous bend in the upper furnace wall venting directly to the header.

In FIG. 3 the spiral wound tube 18 continues to a vertical sinuous tube 25 formed of vertical legs 31, 32, and 33 respectively. The sinuous tube includes an upper return bend 36 and a lower return bend 38 with the outlet leg 40 passing to outlet header 16.

A first flow connection 42 fluidly connects the bottom of each lower return bend 38 to the respective spiral wound tube 18. This connector 42 has a flow area which is substantially less than the flow area of the sinuous tube 25, for instance if the tube has a 1 inch inside diameter, the connector 42 would have an inside diameter in the order of ¼ inch. Accordingly, the flow area is 1/16th that of the tube and for the same flow the velocity would be 16 times as high. The velocity head being the square of the velocity would be 256 times as much in the connector as in the tube.

A second flow connector 44 connects the top of each upper return bend 36 to the head of 16. This flow connector also is substantially less in flow area than the sinuous tube.

The lower connector 42 causes the sinuous tube to be drainable while the upper connector 44 causes it to be vented. Accordingly, the tube is not susceptible to blockage by water, air or steam.

During low load operation when a two phase mixture forms, similar phenomena to the prior art can occur with water collecting in the first tube 31 and flow passing upwardly through connector 42 and tube 33. Because, however, of the substantial restriction in this connector 42, the pressure drop of even small flows is substantial, thereby providing enough pressure differential to clear tube 31 and establish serial flow through the three legs.

Similarly, if the lower return bend 38 tends to block with water, the flow passing through the connector 44 produces substantial pressure drop at even low flows because of its reduced flow area. Sufficient pressure differential is quickly established to force the water pocket out of the tube.

Figure 4:
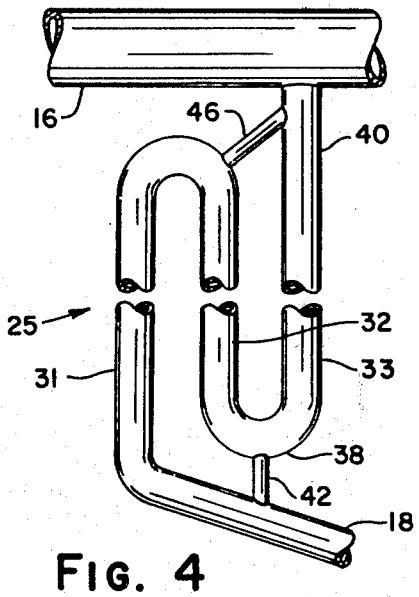
FIG. 4 illustrates the vertical drain sinuous tube vented into the outlet leg thereof.

FIG. 4 shows an arrangement similar to FIG. 3 except that the vent tube 44 passing to header 16 is replaced by a venting connection 46 which causes the loop to vent into outlet leg 40 thereby minimizing the number of penetrations of header 16 and depending on where the roof is located, the number of roof penetrations.

The structure is formed of return bends which may be easily manufactured as compared to the complexities of fabricating a trifurcate. The arrangement is subject to blockage only at extremely low and unrealistic flow rates rather than in the practical low load conditions to which the prior art arrangement is subject. The entire upper furnace wall remains adequately cooled so that individual tubes are not subject to overheating, and thermal expansion stresses are minimized.

I claim:

1. A furnace wall tubing arrangement for the upper end of a spiral wound boiler furnace comprising: an outlet header; a vertically sinuous tube extending upwardly in the furnace wall from each spiral wound tube to said outlet header, and including an upper return bend and a lower return bend; a first flow connecting means fluidly connecting the bottom of each lower return bend to the respective spiral wound tube, said first flow connecting means having substantially less flow area than said sinuous tube; and a second flow connecting means fluidly connecting the top of each upper return bend to said header, said second flow connecting means having substantially less flow area than said sinuous tube.

2. A furnace wall tubing arrangement as in claim 1 wherein said second flow connecting means passes directly to said header.

3. A furnace wall tubing arrangement as in claim 1 wherein said second flow connection means passes to said header by venting into the outlet leg of said sinuous tube.

* * * * *